US009320353B1

(12) United States Patent
Elze et al.

(10) Patent No.: US 9,320,353 B1
(45) Date of Patent: Apr. 26, 2016

(54) COVER FOR OUTDOOR FURNITURE

(76) Inventors: Olaf Dietrich Elze, Walnut Creek, CA (US); Shaw Finlay Sterling, Walnut Creek, CA (US)

( * ) Notice: Subject to any disclaimer, the term of this patent is extended or adjusted under 35 U.S.C. 154(b) by 718 days.

(21) Appl. No.: 13/199,009

(22) Filed: Aug. 17, 2011

Related U.S. Application Data

(63) Continuation-in-part of application No. 12/800,983, filed on May 26, 2010, now abandoned.

(51) Int. Cl.

| | |
|---|---|
| ***A47B 37/04*** | (2006.01) |
| *A45B 23/00* | (2006.01) |
| *A47G 11/00* | (2006.01) |
| *A47G 21/16* | (2006.01) |

(52) U.S. Cl.
CPC ..... *A47B 37/04* (2013.01); *A45B 2023/0012* (2013.01); *A45B 2200/1063* (2013.01); *A47G 21/167* (2013.01); *A47G 2011/005* (2013.01)

(58) Field of Classification Search
CPC ..... A47B 34/04; A47B 85/06; A47B 83/02; A47B 25/00; A47B 37/04; B60J 7/00; E04H 15/02; E04H 15/36; E04H 15/28; A47G 21/167; A47G 2011/005; A45B 2200/1063; A45B 2023/0012
See application file for complete search history.

(56) References Cited

U.S. PATENT DOCUMENTS

| | | | | |
|---|---|---|---|---|
| 814,473 | A * | 3/1906 | Patterson | 135/96 |
| 3,782,435 | A * | 1/1974 | Sherman | 135/16 |
| 4,278,719 | A * | 7/1981 | Sarnecki | 428/78 |
| 4,387,873 | A * | 6/1983 | Pavlo et al. | 248/227.1 |
| 4,865,063 | A * | 9/1989 | Williams | 135/33.7 |
| 5,441,066 | A * | 8/1995 | Harris | 135/88.01 |
| 5,482,374 | A * | 1/1996 | Buhyoff | 383/4 |
| 5,694,866 | A | 12/1997 | Muller | |
| 5,752,736 | A * | 5/1998 | Nodier | 296/100.18 |
| 5,887,530 | A | 3/1999 | Muller | |
| 6,178,979 | B1 * | 1/2001 | Galloway | 135/99 |
| 6,709,055 | B2 | 3/2004 | Gengler et al. | |
| 2003/0117001 | A1 | 6/2003 | Gengler et al. | |
| 2004/0016484 | A1 | 1/2004 | Muller | |
| 2012/0178067 | A1 * | 7/2012 | Stanfield | 434/247 |

* cited by examiner

*Primary Examiner* — Tri Mai
(74) *Attorney, Agent, or Firm* — Allen, Dyer, Doppelt, Milbrath & Gilchrist, P.A.

(57) ABSTRACT

A composite cover for covering an item of furniture comprising a sheet of material laid on a support which is, one embodiment, is on an array of elastic cords and is in another embodiment is a fan array of panels.

6 Claims, 6 Drawing Sheets

COVER FOR OUTDOOR FURNITURE

RELATED APPLICATION

This application is a continuation-in-part of patent application Ser. No. 12/800,983, from which priority is claimed, the contents of this application is hereby incorporated by reference in their entirety.

TECHNICAL FIELD

This invention relates to covers intended to protect outdoor furniture, particularly to protect furniture placed outdoors in all kinds of weather.

BACKGROUND

Furniture such as chairs, tables and lounges, are commonly placed outside in gardens and recreational areas in all parts of the country.

The furniture is exposed to all kinds of weather—rain, snow, bleaching sun,—for long periods of time, even in periods of time when the furniture is not in use. Such periods include winter, stormy weather, night-time etc. During these periods of non-use, the typical home owner typically covers his furniture with covers which are made specifically to cover furniture.

The traditional approach to eliminating collection pockets is to provide form fitting covers intended to shield the furniture from weather elements and debris.

A particular problem presented to home owners is that design and shape of the furniture draped with a cover forms pockets that become collectors of water and debris (particularly leaves). The collection of water and debris grows and becomes particularly objectionable over long periods of time such as during the winter, or when the owner is absent on a vacation trip. The job of removing a cover holding heavy large pockets of watery debris becomes overwhelming and difficult as the size and weight of the collection of debris increases.

The traditional approach to eliminate collection pockets has been to provide form fitting covers intended to shield the furniture from weather elements and debris. This solution has not been satisfactory from the standpoint that furniture comes in a range of sizes, etc., and no one size of cover fits all sizes and designs of furniture. Additionally, the form-fitted cover approach does not prevent collection cavities to occur even when the covers are closely form fitted.

Numerous disclosures have appeared in the patent literature related to the design of covers intended to overcome the debris collection problem for out door furniture.

U.S. Publication 20030117001 discloses a weatherproof covering of flexible material fitted for a variety of furniture designs. A flexible harness of strap members is secured permanently by sewing or removably by velcro to the flexible material. A bar with hook ends is attachable to an edge of the material that performs as a weight intended to maintain the material in its position.

U.S. Publication 2004/0016484 discloses a cover having a UV resistant outer layer.

U.S. Pat. No. 6,709,055 discloses a cover to which flexible straps are sewn. The flexibility of the straps and design of the cover permits that the cover may be used to cover furniture having any one of a number of designs.

U.S. Pat. No. 5,694,866 discloses a cover for an umbrella table wherein the umbrella pole extends through an opening in the center of the cover. The cover is releasably secured to the pole.

U.S. Pat. No. 5,887,530 discloses a cover for an umbrella table in which the umbrella extends through the cover draped over the table. Inclined drain channels are formed by the cover draped over the table with the umbrella pole extending through the center of the table and cover and supporting the cover in an inclined position to facilitate drainage over the edges of the covered table.

None of the disclosures have adequately resolved the problem of eliminating the formation of debris laden pools of water from outdoor furniture.

SUMMARY

It is an object of this invention to provide an all-weather cover for protecting an article of outdoor furniture.

It is a further object of this invention to prevent the accumulation of (rain) water and (leaf, sticks, paper) debris on exposed surfaces such as table tops.

This invention is directed toward a cover for protecting tables and outdoor furniture, in general, from accumulation of rain water such as typically occurs on table tops. The outside edge of the cover has a shape and size which permit draping the cover completely over an item of furniture.

Means are provided, according to the invention, to prevent the cover from sagging against the covered furniture (table top) and forming depressions where rain water would otherwise collect. The rainwater will therefore drain off the covered furniture.

In one embodiment of the invention, that is particularly adapted to covering a table, a plurality of elastic cords (bungee cords) is provided. Each bungee cord has one end attached to the top end of a vertical center pole extending from the center of the table and opposite ends of the cords fastened to an edge of the table. The cover is supported like a circus tent over the table so that rainwater runs off the sloping surface of the cover (tent).

In yet another embodiment, a plurality of panels are positioned over the table. The panels are supported by the center pole and fan out from one another and rest against the outer edges of the table.

DISCUSSION OF PREFERRED EMBODIMENTS

Figure 1:
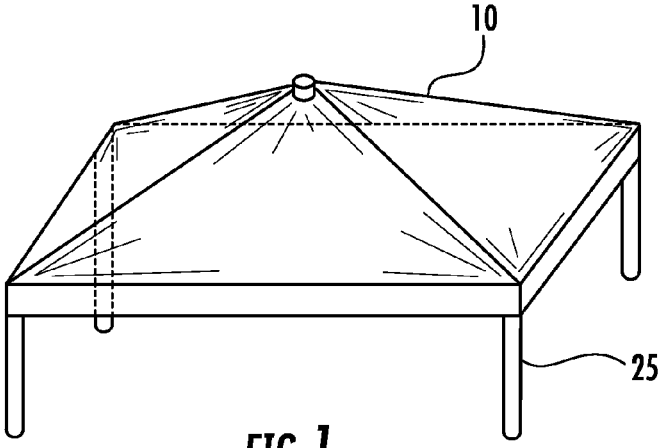
FIG. 1. Shows a cover supported over a table top.

Turning now to a discussion of the drawings, FIG. 1 shows the composite cover of this invention that comprises a sheet 10 positioned over a support. The support is concealed under sheet 10 in FIG. 1. The support is adapted to supporting the sheet 10 like a tent over a table 25 and provides that accumulation of water is prevented in depressions formed in the sheet 10 over the table top.

The support is concealed by the sheet 10 in FIG. 1. The sloping surface of the sheet 10 prevents rain water from collecting on the top of table 25.

Figure 2:
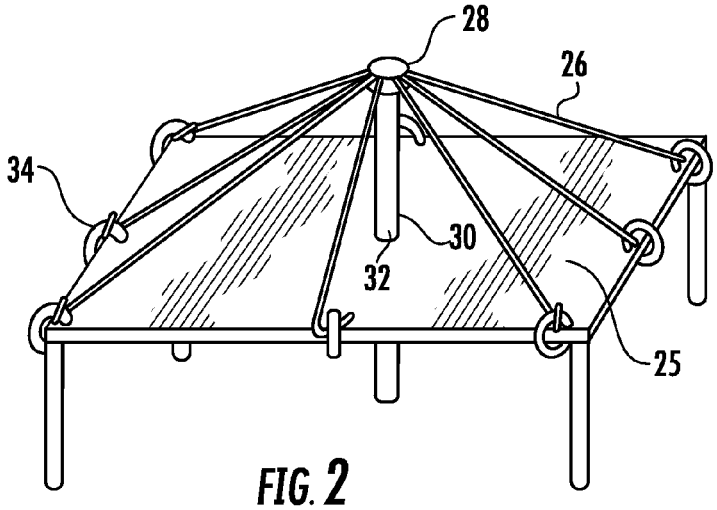
FIG. 2 shows the cover of FIG. 1 removed revealing an array of bungee cords fanned out from a center pole and arranged for supporting a cover over the table.

FIG. 2 shows one embodiment of the support for the sheet 10. The sheet 10 is removed in FIG. 2. The support comprises a plurality of elastic cords 26 (bungee cords). Each cord 26 has one end attached to the top 28 of a center pole 30 extending vertically through a hole 32 in the center of the table 25 to the ground. An opposite end of each bungee cord 26 is attached to the periphery of the top of table 25.

Figure 3:
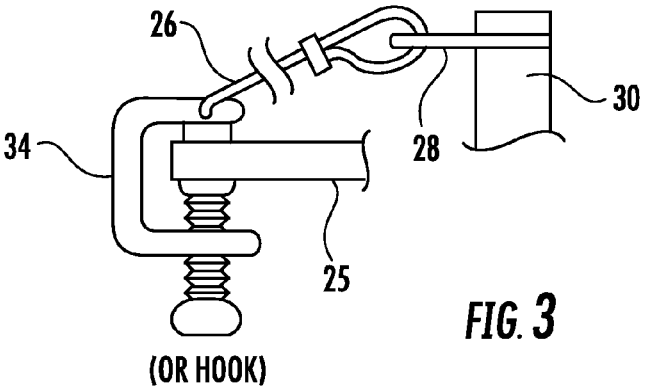
FIG. 3 shows details of means for attaching the bungee cords to the periphery of the table of FIG. 1.

FIG. 3 shows, to best advantage, attachment of one end of the bungee cord 26 to the top end 28 of center pole 30. An opposite end of each cord 26 is fastened to an edge of the table 25 by a C clamp 34.

As shown in FIG. 1, the cover 10 is supported like a tent over the table 25 so that rainwater runs off the sloping surface of the cover thereby preventing accumulation of rainwater on the table 25.

The sheet is preferably a fabric being any one of a water proof canvas and a plastic.

Figure 4:
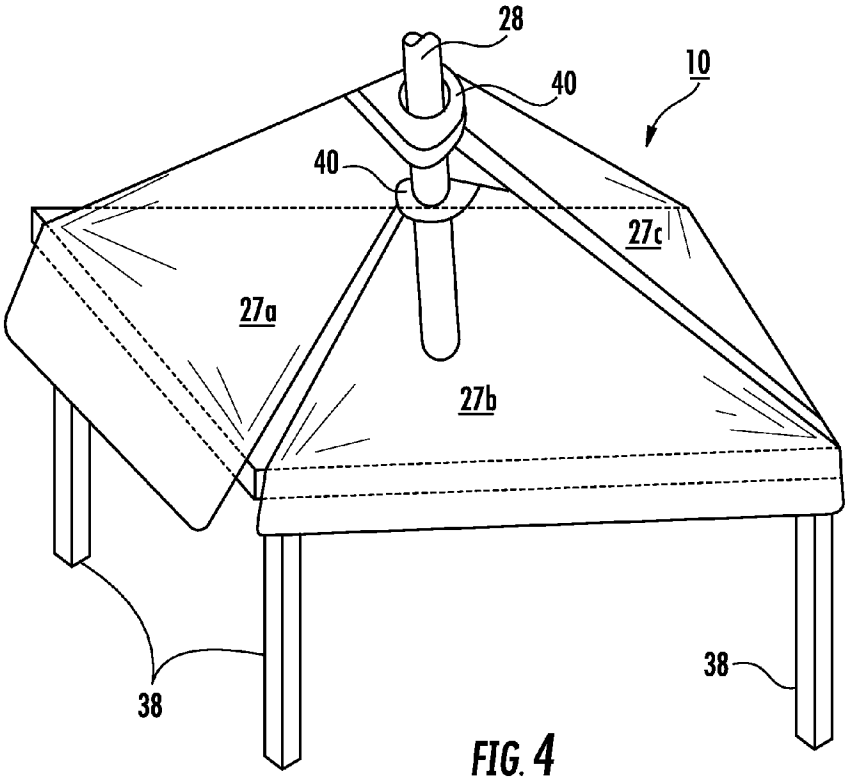
FIG. 4 shows another embodiment, being a plurality of panels (in place of bungee cords) positioned over the table and under the cover.

FIG. 4 is a perspective view of another embodiment of the support being an array of panels 36 *b, c, d*, overlying the top of a table 25 to be protected from weather elements. Legs 38 of the protected table 25 are shown in FIG. 4.

Figure 5:
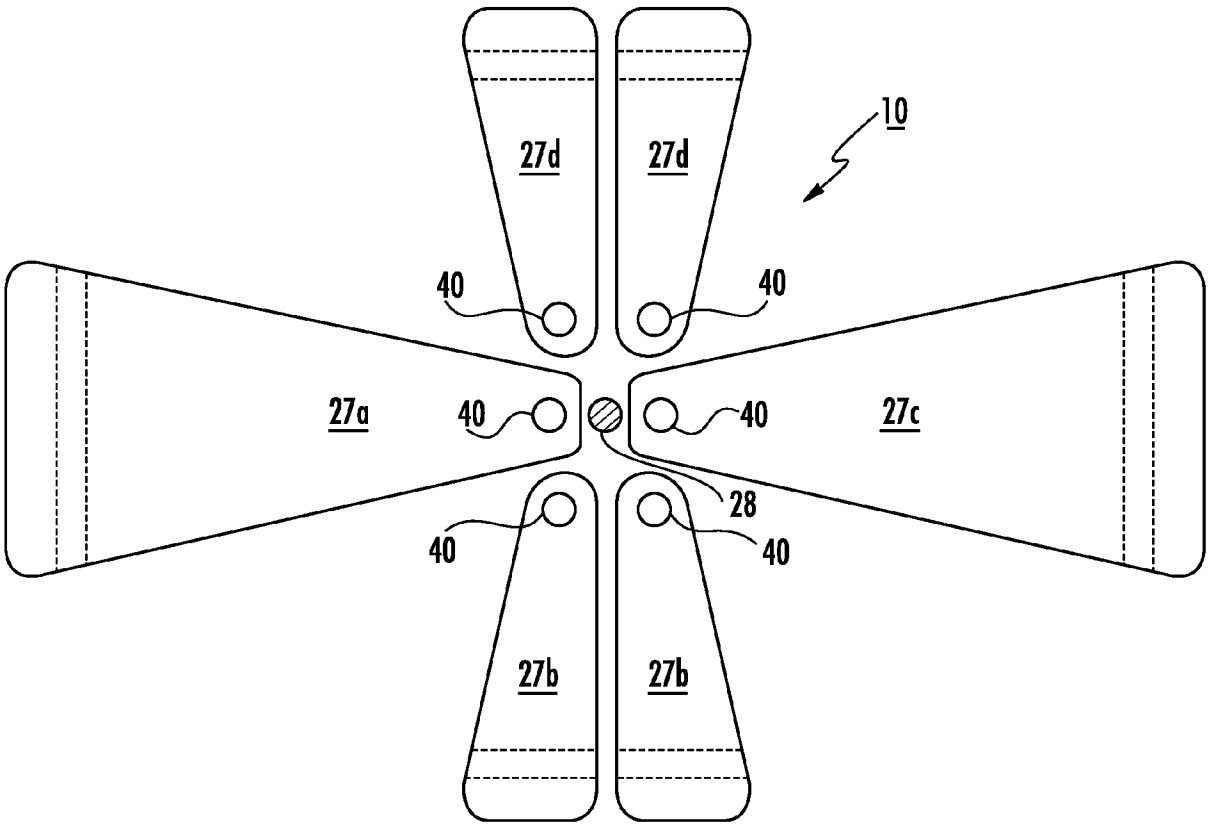
FIG. 5 shows an array of panels being six sections arranged to cover an oblong table.

FIG. 5 is a top view of the array of panels of FIG. 4 illustrating the shape and of the individual panels selected to accommodate the dimensions of the table top. Six panels are shown in FIG. 5 to cover a table that is oblong. Each panel has a substantially triangular shape and an opening 40. in one corner. As shown in FIG. 4, the panels are arranged "fanned" around the table 25 with a center pole 28 of the table extending through the hole 40 in each panel. Each individual panel extends out to the adjacent section of edge of the table 25.

In one manner of use, where the table top to the protected is small, the "panel shield" of FIG. 4 is used as shown with no additional sheet over the panel shield.

In another manner of use, where the table is large, a fabric cover is positioned over the array of panels as shown in FIG. 1. There has been described an invention that shields outdoor furniture from collection of debris generated by in inclement weather.

It is an object of this invention to provide an all-weather cover for protecting an article of outdoor furniture. It is a further object of this invention to prevent the formation of depressions formed by covers laid over furniture wherein said depression would become regions where pools of water (rain and snow) and debris (leaves, sticks, etc.) would accumulate.

It is a further object that the prevention of a depression formation be applicable to a variety of furniture articles that differ in size within an acceptable size range. It is a further object that the positioning of the cover over the furniture and its subsequent removal is well within the physical capability of the typical furniture owner.

This invention is directed toward an outer cover of material. The material is preferably a waterproof or water-resistant and aids in shedding rainwater and melting snow and ice. The outside edge of the cover deforms a sheet having a shape and size to permit draping the cover completely over an item of furniture (chair, lounge, table, etc.). The item of furniture is in a size and shape range that would include many such similar items on the market.

The cover is provided with a means for attaching an inflatable bladder against the inside surface of the cover. Various means of attaching the bag are contemplated according to several embodiments of the invention such that a broad area of the inside surface of the cover is against a broad area of the surface of the bladder.

In one embodiment, the means for attaching the bladder is a material bag having an outside surface that is attachable against the inside surface of the cover, with the bladder positioned inside the material bag. The bladder communicates with one end of an air valve that extends from the bladder through the cover to a detachable source of pressurized air.

When the cover is in position over the furniture, the location of the bladder (secured to the inside surface of the cover), is in a location where a depression or flat spot would otherwise form (without the bladder). When the item to be covered is a chair, the preferred location of the bladder is the seat of the chair so that the inflated bladder forms a "bulge" where a depression would otherwise form in the absence of the inflated bladder. When the item to be covered is a table, the preferred location of the bladder is the top of the table so that the inflated bladder forms a bulge on the table top causing rainwater, melting snow and ice, and debris to drain off the covered table top. In practice, the cover with bladder attached is laid over the chair with the bladder positioned in the seat of the chair. The bladder is inflated through the air valve extending through the opening in the cover.

Figure 6:
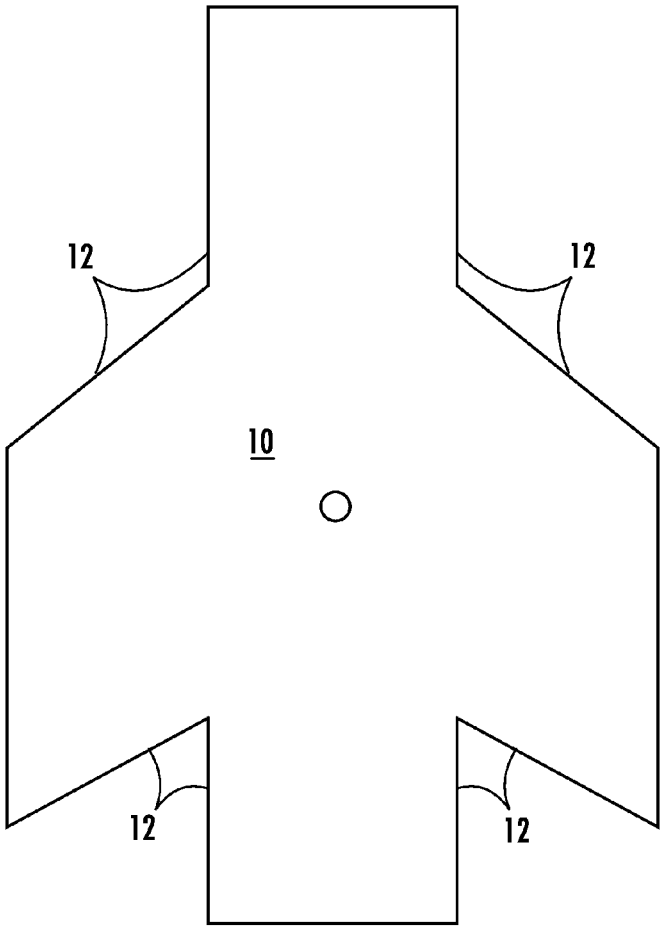
FIG. 6 shows the un-sewn cover of this invention.
Figure 7:
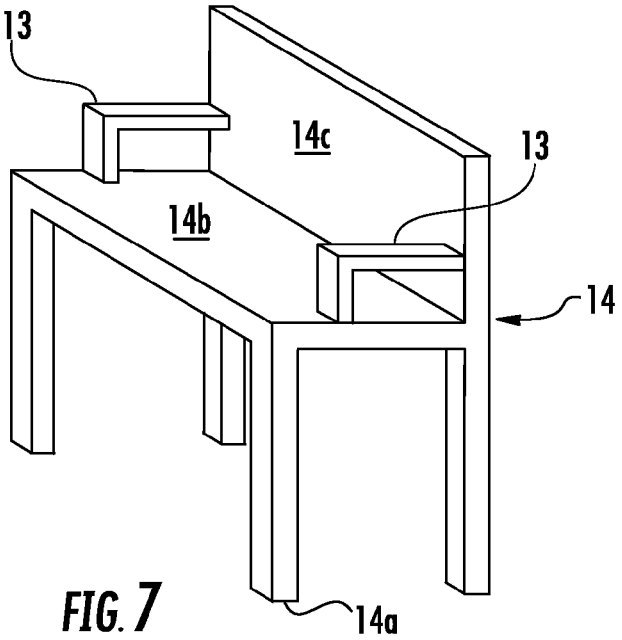
FIG. 7 shows a chair that is to be covered by the cover in FIG. 6.

Turning now to a discussion of the drawings, FIG. 6 shows a cover 10 with "un-sewn" seams 12. The cover 10 is shown laid flat to illustrate the shape of the cover 10 before the seams 12 are sewn together. FIG. 7 shows a chair 14 BEFORE the chair 14 is covered by the finished (sewn) cover 10 of this invention. (Cover 10 is NOT shown in FIG. 7) . The chair 14 has four legs 14A, a seat l4B, and a back l4C. Typical chairs include two arms 13 (although some do not have arms), one arm on each side of the chair 14.

Figure 8:
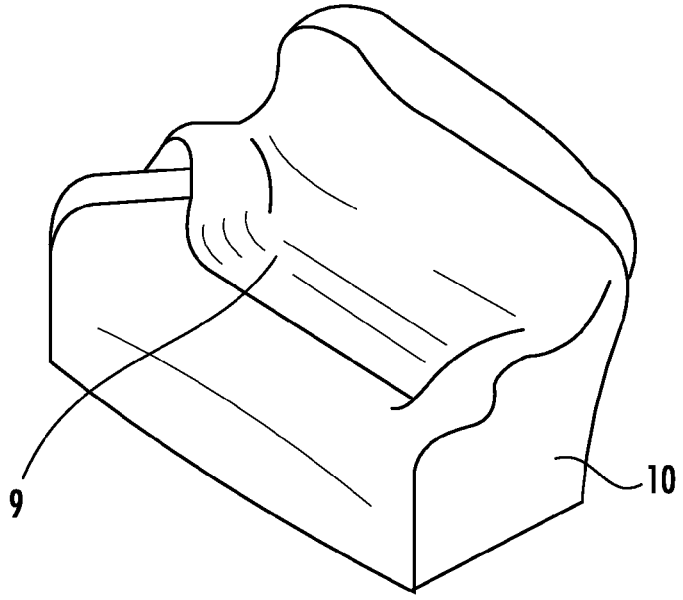
FIG. 8 shows a cover draped over the chair of FIG. 7 wherein a depression is formed by the cover in cooperation with the arms and seat of the chair.

As shown in FIG. 8, when a cover 10 is laid over the chair 14, a "depression" 9 is formed in the area of the seat l4B of the chair 14. Chair 14 is concealed by the cover 10 in FIG. 8. The depression 9 is formed in the seat 14 B of the chair 14 (when the chair is covered) by the cover 10 in combination with the arms l4A, seat l4B, and back l4C of the chair 14.

During inclement weather, rainwater and debris collect in the depression 9. It is an object of this invention to remove the depression formed by the cover 10 over the covered chair 14 to prevent collection of rainwater.

Figure 9A:
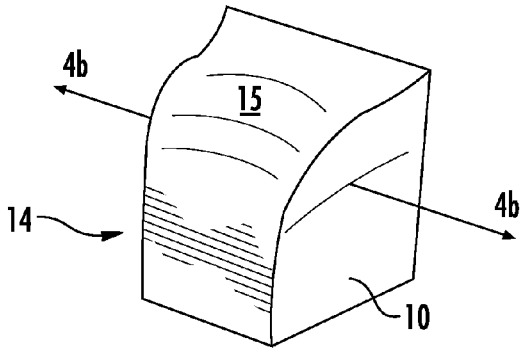
FIG. 9A shows a chair covered by the composite cover 10 of this invention in which an inflated bladder is positioned between the cover and seat so that a swelling of the bladder removes the depression in the cover. Bladder 16 is obscured in FIG. 9A.
Figure 9B:
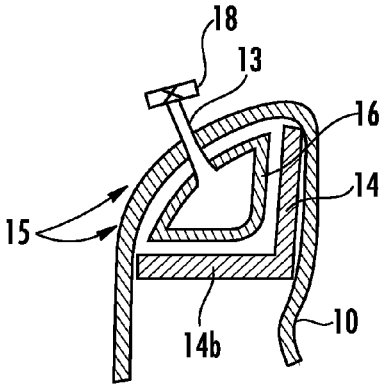
FIG. 9B is a sectional view of the chair 14, bladder 16, cover 10 and valve 18.

FIG. 9A is a perspective view of chair 14 covered by the cover 10 of this invention in which a depression 9 of the cover shown in Fig. 8 is replaced by a swelling 15 illustrated in FIG. 9A. FIG. 9B is a sectional view of the cover 10 over chair 14 taken along line of sight 9B - 9B shown in FIG. 9A.

FIG. 9B shows an inflated bladder 16 positioned between cover 10 and chair 14. The inflated bladder 16 has effectively "filled in" the depression 9 so that rainwater can no longer collect in the depression 9 over the seat 14C. The bladder 16 is secured to the inside surface of the cover 10 between the cover 10 and seat 14B of the chair 14 so that a depression of cover 10 is NOT formed which would otherwise catch rainwater and debris in the absence of the air bladder 16.

The bladder 16 is inflated through an air valve 18 connected to pressurized air that communicates with the bladder 16 through an opening 13 in the cover 10. The depression 9 is replaced by a swelling 15. The swelling 15 of cover 10 due to the inflated air bladder 16 in the seat area 14B of covered chair 14 is shown in Fig. 9 indicating the obscured presence of the inflated bladder 16. The swelling 15 prevents collection of rainwater in the seat area l4B. An air valve 18 is shown in FIG. 9B extending through an opening 13 in cover 10.

Modifications (not shown) of the cover 10 are made to accommodate various designs and sizes of the furniture. There has been described a cover which prevents the collection of water depressions formed by a cover laid over outside furniture. Various means may be applied, according to the invention, to attach the bladder 16 to the inside surface of the cover 10 in order to retain the position of the bladder between seat area 14B and the cover 10.

Figure 10:
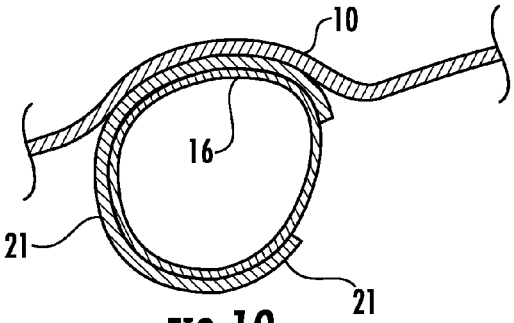
FIG. 10 is a sectional view of an embodiment including the cover, bladder, and bag containing the bladder. The bag is secured to the inside surface of the cover such as by stitching or welding.

FIG. 10 is a cutaway sectional view showing one embodiment in which the bladder 16 is secured in position within the cover 10 by inserting the bladder 16 into a bag 21 that is secured to the inside surface of the cover 10.

Figure 11:
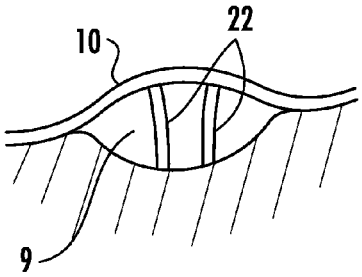
FIG. 11 shows inflexible ribs/stakes or flexible battens positioned in the area of a depression and supporting the cover to form a swelling of the cover to prevent collection of water.

FIG. 11 shows another means of replacing depression with swellings by positioning a plurality of inflexible ribs/stakes or flexible battens 22 inside the cover 10. A rib 22 is shown at a location selected to overcome formation of a depression 9 in the cover draped over the furniture. The cover is preferably a sheet of material being any one of a waterproof or water-resistant and aids in shedding rainwater and melting snow and ice.

Figure 12:
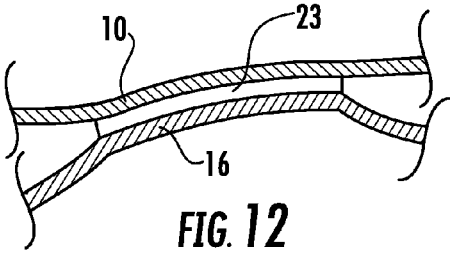
FIG. 12 shows the air bladder 16 (cutaway) attached to the inside surface of the cover 10 by hook and eye material 23 well known in the art under the name VELCRO ™.

FIG. 12 shows another embodiment, the air bladder 16 (cutaway) is attached to the inside surface of the cover 10 by hook and eye material 23 well known in the art under the name VELCRO™. It will be understood that the invention is illustrated in this specification by its application to a chair with arms as discussed in connection with FIGS. 7, 8 and 9. It is apparent that the invention is also adaptable to other items of furniture such as a table, lounge, etc., which would clearly require different shape and design of the cover 10 and bladder 16 to prevent the formation of depressions.

Variations and modifications of this invention may be contemplated after reading the specification and studying the drawings which are within the scope of the invention. In view of these and other modifications that may be contemplated after reading the specification, it is wished to define the scope of the invention by the appended claims.

What is claimed is:

1. A table item comprising:

a rigid top;

a plurality of legs extending from the rigid top, the rigid top having at least one opening therein; and a cover for the rigid top and comprising a pole extending through the at least one opening in the rigid top and having a lower end adjacent a floor, and an upper end extending upwardly from the rigid top, a plurality of fasteners coupled to a periphery of the rigid top, each fastener comprising a C-shaped clamp for clamping onto a peripheral edge and upper surface of the rigid top, and a stud being threaded externally for cooperation with said C-shaped clamp and applying pressure to a lower surface of the rigid top, a plurality of supports extending between the upper end of said pole and respective ones of said plurality of fasteners, and a cover layer extending over said pole and said plurality of supports, said pole and said plurality of fasteners for preventing depressions on an upper surface of said cover layer.

2. The table item of claim 1 wherein said plurality of supports comprises a plurality of elastic tethers.

3. The table item of claim 1 wherein said cover layer comprises at least one of waterproof canvas and plastic.

4. The table item of claim 1 wherein said cover layer has flat surfaces between said plurality of supports.

5. The table item of claim 1 wherein said pole extends through the at least opening in a center of the rigid top.

6. The table item of claim 1 wherein said pole comprises a cylinder-shaped pole.

* * * * *